United States Patent [19]

Bauer et al.

[11] 4,001,638

[45] Jan. 4, 1977

[54] IGNITION SYSTEM

[75] Inventors: Frederick T. Bauer; Frederick J. Geary, both of Holland, Mich.

[73] Assignee: Robertshaw Controls Company, Richmond, Va.

[22] Filed: Nov. 29, 1974

[21] Appl. No.: 528,158

[52] U.S. Cl. ..... 315/209 SC; 315/209 CD; 317/96; 431/264

[51] Int. Cl.[2] ..... H05B 37/02; F23Q 3/00

[58] Field of Search ..... 307/252 N; 315/209 CD, 315/209 SC; 317/79, 96; 431/66, 74, 264, 266

[56] References Cited

UNITED STATES PATENTS

| | | | |
|---|---|---|---|
| 3,338,288 | 8/1967 | Walker | 317/96 X |
| 3,849,670 | 11/1974 | Lourigan | 317/96 |
| 3,870,929 | 3/1975 | Carlson | 317/96 |
| 3,894,524 | 7/1975 | Burkett et al. | 315/209 CD X |

*Primary Examiner*—R. V. Rolinec
*Assistant Examiner*—Lawrence J. Dahl
*Attorney, Agent, or Firm*—Malcolm R. McKinnon

[57] ABSTRACT

A solid state ignition system particularly adapted for use in igniting fuel oil, the system including plasma generator means, electronic trigger means and electronic brake means and being effective to produce an improved ionization arc between electrodes for the purpose of initiating fuel oil combustion.

7 Claims, 6 Drawing Figures

IGNITION SYSTEM

BRIEF SUMMARY OF THE INVENTION

This invention relates to ignition systems and, more particularly, to an improved solid state ignition system incorporating improved circuitry effective to produce an improved ionization arc between electrodes for the purpose of initiating combustion of fuel oil.

An object of the present invention is to overcome disadvantages in prior ignition systems of the indicated character and to provide an improved solid state ignition system which incorporates improved means for producing a high frequency and high energy ionization arc effective to initiate combustion of fuel oil in a minimum of time.

Another object of the invention is to provide an improved solid state ignition system which is adapted to produce a high frequency and high energy ionization arc between electrodes effective to initiate combustion of fuel oil and which is readily adaptable to meet the ignition requirements of various types of oil burners.

Another object of the invention is to provide an improved solid state ignition system which is adapted to utilize line voltage for the circuitry thereof.

Still another object of the invention is to provide an improved solid state ignition system which is economical to manufacture and assemble, durable, efficient and extremely reliable in operation.

The above as well as other objects and advantages of the present invention will become apparent from the following description, the appended claims and the accompanying drawings.

DETAILED DESCRIPTION

Figure 1:
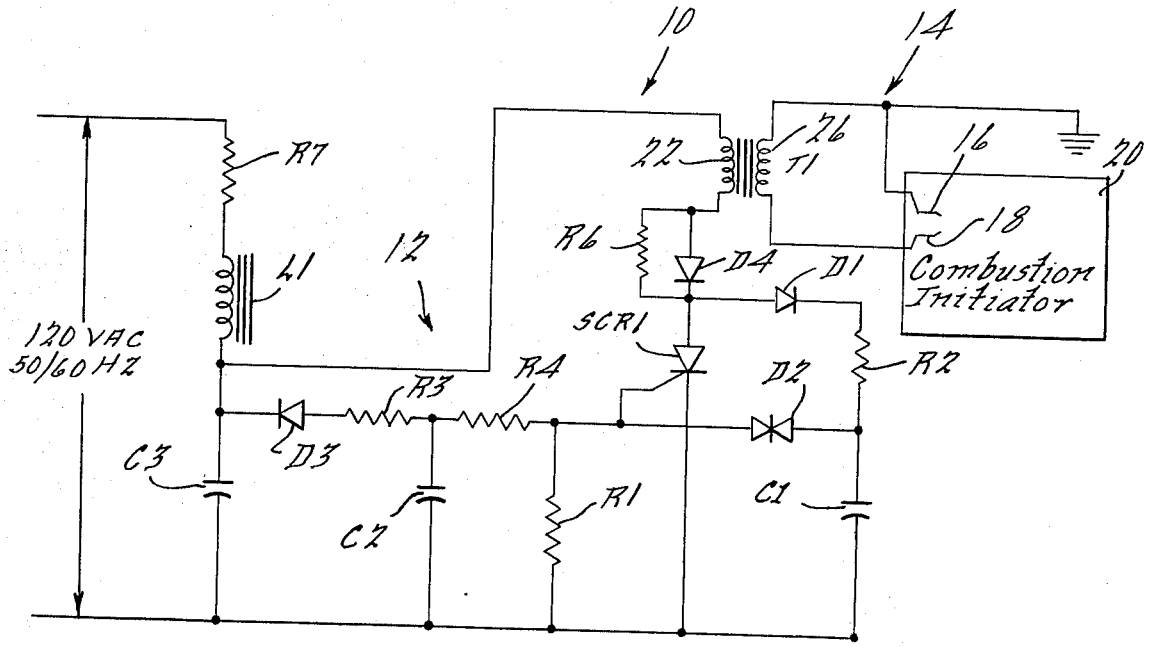
FIG. 1 is a schematic diagram of an ignition system embodying the present invention.

Referring to the drawings, and more particularly to FIG. 1 thereof, a schematic diagram of an ignition system, generally designated 10, embodying the present invention is illustrated therein. As shown in FIG. 1, the system 10 is adapted to be connected to a conventional source of line voltage alternating current, such as conventional nominal 115 volt or nominal 250 volt alternating current. The system 10 includes a plasma generator circuit, generally designated 12 and a combustion initiator circuit, generally designated 14, the above described circuitry all being electrically connected by suitable conductors as illustrated in the drawings and as will be described hereinafter in greater detail.

In general, the ignition system 10 illustrated in FIG. 1 operates in the following manner: Line voltage is supplied to the system 10 from the main line source of AC current to the plasma generator circuit 12 and the associated combustion initiator circuit 14 for combustion initiation. Applied line voltage at a nominal supply of 115 VAC or 250 VAC causes the plasma generator circuit 12 to initiate a unidirectional high frequency ionic breakdown across electrodes 16 and 18 located within a combustion chamber 20, a burner motor or other means (not shown) being provided to cause oil to be sprayed into the combustion chamber 20. The oil particles pass through the ionic discharge area of the electrodes 16 and 18 incorporated in the combustion initiator circuit 14 and are ignited after which the system 10 may be deenergized in any desired manner.

Figure 2:
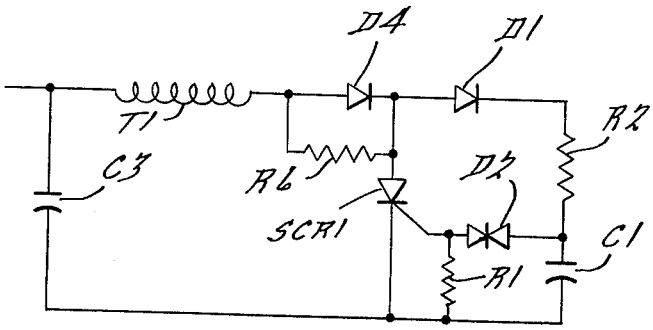
FIG. 2 is a schematic diagram illustrating the circuitry of the plasma generator incorporated in the system illustrated in FIG. 1.

Referring in greater detail to the circuits hereinabove mentioned, the plasma generator circuit 12, illustrated in FIG. 1, may be divided into three sections illustrated in FIG. 2 for ease of description. These sections comprise 1) a trigger made up of resistors R1 and R2, a diode D1, a capacitor C1 and a trigger diode D2 connected across a silicon controlled rectifier SCR1; 2) an "electronic brake" comprising a diode D3, a capacitor C2 and resistors R3, R4 and R1 connected in parallel to the capacitor C3; and 3) the plasma generator proper comprising the silicon controlled rectifier SCR1, a transformer T1, the capacitor C3, a diode D4 and a resistor R6.

Alternating voltage applied to the circuit 12 causes the capacitor C3 to charge to some value of voltage (positive or negative), the rate of charge being determined by the inductance of a choke L1, its DC resistance, and the resistance of a resistor R7. During the negative swing of the line voltage, the capacitor C3 charges to the magnitude of the line voltage in a sinesoidal manner. As the line voltage crosses through zero and begins its positive rise, the capacitor C3 charges toward a positive voltage. Since the silicon controlled rectifier SCR1, through the primary winding 22 of the transformer T1, is parallel to the capacitor C3, the silicon controlled rectifier SCR1 cannot conduct during the negative half cycle of the voltage. When the capacitor C3 charges toward a positive voltage this voltage occurs across the silicon controlled rectifier SCR1 anode to cathode.

This same voltage is placed across the resistor R2 and the capacitor C1. Consequently, the capacitor C1 begins to charge to a positive voltage at a rate determined by its capacitance and the resistance of the resistor R2. When the voltage across the capacitor C1 reaches a magnitude of from 28 to 36 volts, it causes the trigger diode D2 to break down, thus discharging the capacitor C1 through the resistor R1 and causing the silicon controlled rectifier SCR1 to turn on through its gate 24. The diode D1 prevents any negative voltage being applied to this circuit.

Figure 3:
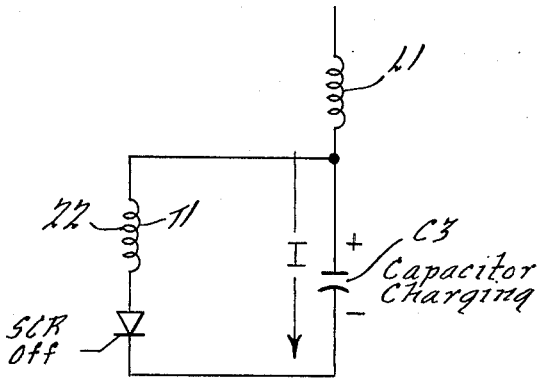
FIGS. 3, 4, 5 and 6 are schematic circuit diagrams illustrating the operation of the circuitry of FIG. 1.
Figure 4:
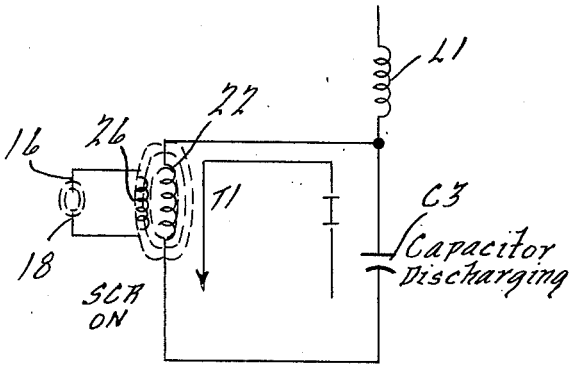
Figure 5:
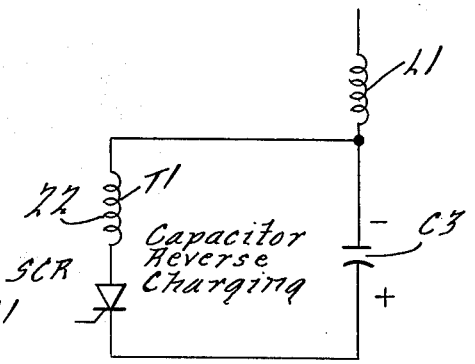

As shown in FIGS. 3, 4 and 5, when the silicon controlled rectifier SCR1 turns on it changes from an open circuit to essentially a short circuit. The high voltage transformer T1 primary winding 22 is then placed directly across the capacitor C3. The low impedance primary winding 22 of the transformer T1 when suddenly placed across the capacitor C3 causes the capacitor C3 to instantaneously discharge. The impedance of the choke L1 momentarily resists the line voltage from maintaining the charge on the capacitor C3. The capacitor C3 then discharges through the primary winding 22 of the transformer T1 and the silicon controlled rectifier SCR1. This discharge causes the transformer T1 to build a magnetic field which cuts its secondary winding 26, generating a high voltage ionization at the ignition electrodes 16 and 18. As the discharge energy of the capacitor C3 diminishes the magnetic field of the transformer T1 collapses, forcing current to continue through the silicon controlled rectifier SCR1 in the same direction and causing the capacitor C3 to be charged to the opposite polarity of voltage.

Negative voltage is reflected across the silicon controlled rectifier SCR1 anode to cathode. Negative voltage is also developed from gate to cathode through the aforementioned electric brake section comprising the diode D3, the resistor R3, the filter C2, the resistor R4 and the resistor R1.

Figure 6:
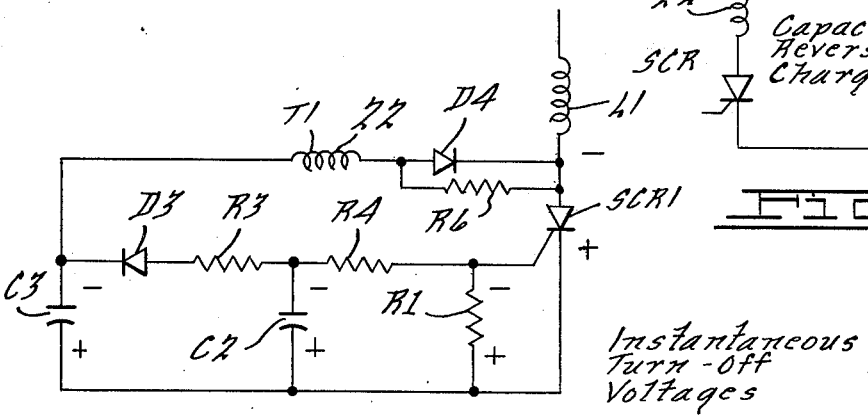

As illustrated in FIG. 6, this negative voltage applied from anode to cathode and maintained from gate to cathode causes the silicon controlled rectifier SCR1 to instantly turn off and again to assume an open circuit condition. When the field of the transformer T1 collapses, the energy for the first microsecond creates an approximate 1200 volt negative spike. Since the silicon controlled rectifier SCR1 is already in conduction and is essentially a slow recovery device (with respect to one microsecond) a very large surge current could be forced through the silicon controlled rectifier SCR1, and such a surge could result in the silicon controlled rectifier dissipating power in the form of heat thereby causing a heat rise which would reduce the capabilities of the silicon controlled rectifier by narrowing its operating parameters. In accordance with the present invention, such a situation is prevented from occurring by the parallel combination of the diode D4 and the resistor R6. The diode D4 is a fast recovery diode which has an approximate 200 nanosecond turn off time. Therefore, when the transformer T1 causes the negative voltage to be developed, the diode D4 "turns off" immediately forcing its parallel resistor R6 to absorb the majority of the negative spike thus relieving the silicon controlled rectifier SCR1 from the unnecessary surge of the first nanosecond of the turn off cycle. This action limits the negative voltage applied to the silicon controlled rectifier SCR1 to about 500 volts. It should be understood that once gated, the silicon controlled rectifier SCR1 is very difficult to turn off reliably, and yet the silicon controlled rectifier SCR1 must be turned off to achieve a multiplicity of ignition pulses during the short time of one-half of the AC voltage waveform. Since only a very small increment of the positive half cycle of applied voltage was consumed during the generation of this pulse, the capacitor C3 again assumes a positive charge, beginning however, from a negative voltage. The above process repeats itself approximately 40 times during each positive half cycle of the applied line voltage. This results in what appears to be a steady ionization arc across the electrodes 16 and 18. It will be understood that oil requires much energy to ignite, and that, additionally, the ion path directly between the electrodes 16 and 18 should not be in the oil spray itself or malfunction could result. Consequently, these rapid multiple discharges are preferably "blown" into the oil spray by a blower section incorporated in the means spraying oil into the combustion chamber 20.

Typical values for the components in the control system described hereinabove are as follows:

| | |
|---|---|
| C1 | .02 MFD at 200 VDC |
| C2 | .02 MFD at 200 VDC |
| C3 | .33 MFD at 600 VDC |
| R1 | 560 ohms ½ Watt |
| R2 | 22K ohms ½ Watt |
| R3 | 6.8K ohms 1 Watt |
| R4 | 1K ohms ½ Watt |
| R6 | 330 ohms 1 Watt Wire Wound |
| R7 | 10 ohms 22 Watt Wire Wound |
| D1 | IN4004 |
| D2 | ST2 |
| D3 | IN4004 |

-continued

| | |
|---|---|
| D4 | RCA 44933 |
| SCR1 | RCA-C106-D |
| L1 | Choke Coil |
| T1 | High Voltage Transformer |

It will be understood, however, that these values may be varied depending upon the particular application of the principles of the present invention.

While a preferred embodiment of the invention has been illustrated and described, it will be understood that various changes and modifications may be made without departing from the spirit of the invention.

What is claimed is:

1. In an ignition system, the combination comprising plasma generating means adapted to be connected to a main line source of AC current, and combustion initiation means operatively connected to said plasma generating means, said plasma generating means including a silicon controlled rectifier having an anode, a cathode and a gate, a transformer having a primary winding and a secondary winding, a first capacitor, a first diode and a first resistor, said primary winding and said first diode being connected in series with said anode and said cathode, said first resistor being connected in parallel with said first diode, said first capacitor being connected in parallel with said anode and said cathode through said primary winding, said plasma generating means also incuding trigger means, said trigger means including said silicon controlled rectifier, second and third resistors, a second diode, a second capacitor and a trigger diode, said second resistor, said second diode, said second capacitor and said trigger diode being connected across said anode and said cathode of said silicon controlled rectifier, said third resistor being connected to said gate.

2. In an ignition system, the combination comprising plasma generating means adapted to be connected to a main line source of AC current, and combustion initiation means operatively connected to said plasma generating means, said plasma generating means including a silicon controlled rectifier having an anode, a cathode and a gate, a transformer having a primary winding and a secondary winding, a first capacitor, a first diode and a first resistor, said primary winding and said first diode being connected in series with said anode and said cathode, said first resistor being connected in parallel with said first diode, said first capacitor being connected in parallel with said anode and said cathode through said primary winding, said plasma generating means also including trigger means and electronic brake means, said trigger means including said silicon controlled rectifier, second and third resistors, a second diode, a second capacitor and a trigger diode, said second resistor, said second diode, said second capacitor and said trigger diode being connected across said anode and said cathode of said silicon controlled rectifier, said third resistor being connected to said gate, said electronic brake means comprising a third capacitor, a third diode and fourth and fifth resistors, said third diode, said third, fourth and fifth resistors and said third capacitor being connected in parallel with said first capacitor.

3. In an electrical control system for oil burners, the combination comprising plasma generating means adapted to be connected to a main line source of AC current, and combustion initiation means controlled by said plasma generating means, said plasma generating means including a silicon controlled rectifier having an anode, a cathode and a gate, a transformer having a primary winding and a secondary winding, a first capacitor, a first diode and a first resistor, said primary winding and said first diode being connected in series with said anode and said cathode, said first resistor being connected in parallel with said first diode, said first capacitor being connected in parallel with said anode and said cathode through said primary winding, said plasma generating means also including trigger means, said trigger means including said silicon controlled rectifier, second and third resistors, a second diode, a second capacitor and a trigger diode, said second resistor, said second diode, said second capacitor and said trigger diode being connected across said anode and said cathode of said silicon controlled rectifier, said third resistor being connected to said gate.

4. In an electrical control system for oil burners, the combination comprising plasma generating means adapted to be connected to a main line source of AC current, and combustion initiation means controlled by said plasma generating means, said plasma generating means including a silicon controlled rectifier having an anode, a cathode and a gate, a transformer having a primary winding and a secondary winding, a first capacitor, a first diode and a first resistor, said primary winding and said first diode being connected in series with said anode and said cathode, said first resistor being connected in parallel with said first diode, said first capacitor being connected in parallel with said anode and said cathode through said primary winding, said plasma generating means also including trigger means and electronic brake means, said trigger means including said silicon controlled rectifier, second and third resistors, a second diode, a second capacitor and a trigger diode, said second resistor, said second diode, said second capacitor and said trigger diode being connected across said anode and said cathode of said silicon controlled rectifier, said third resistor being connected to said gate, said electronic brake means comprising a third capacitor, a third diode and fourth and fifth resistors, said third diode, said third, fourth and fifth resistors and said third capacitor being connected in parallel with said first capacitor.

5. The combination as set forth in claim 4, said combustion initiation means including said secondary winding, and a pair of spaced electrodes electrically connected to said secondary winding.

6. The combination as set forth in claim 5, including choke means electrically connected in series with said primary winding.

7. The combination as set forth in claim 6, including additional resistance means connected in series with said choke means.

* * * * *